US007311042B2

(12) United States Patent
Mori

(10) Patent No.: US 7,311,042 B2
(45) Date of Patent: Dec. 25, 2007

(54) STENCIL SCREEN PLATEMAKING APPARATUS

(76) Inventor: Shigeharu Mori, 23-7 Tsukaguchi-honmachi 1-chome, Amagasaki-shi, Hyogo 661-0001 (JP)

( * ) Notice: Subject to any disclaimer, the term of this patent is extended or adjusted under 35 U.S.C. 154(b) by 170 days.

(21) Appl. No.: 11/272,908

(22) Filed: Nov. 14, 2005

(65) Prior Publication Data

US 2007/0051254 A1 Mar. 8, 2007

(30) Foreign Application Priority Data

Sep. 5, 2005 (JP) ..... 2005-256664

(51) Int. Cl.
*B41C 1/14* (2006.01)

(52) U.S. Cl. ..... 101/128.4; 101/127.1; 101/129

(58) Field of Classification Search ..... None
See application file for complete search history.

(56) References Cited

U.S. PATENT DOCUMENTS 4,363,289 A * 12/1982 Gasser ..... 101/128.4
5,687,646 A * 11/1997 Sakaguchi ..... 101/128.4
5,701,816 A * 12/1997 Fujiwara et al. ..... 101/128.4
5,819,653 A * 10/1998 McCue ..... 101/128.4
5,875,712 A * 3/1999 Ericsson et al. ..... 101/128.4
6,834,583 B1 * 12/2004 Miller et al. ..... 101/128.4

* cited by examiner

*Primary Examiner*—Jill E. Culler
(74) *Attorney, Agent, or Firm*—Schweitzer Cornman Gross & Bondell LLP

(57) ABSTRACT

A stencil screen platemaking apparatus for a heat-sensitive platemaking method, having a thermal head retaining frame to which a thermal head is attached arranged to oppose a platen roller retaining frame having a platen roller attached thereto, and a stepping motor, in a manner permitting contact and separation between the thermal head and the platen roller. In the separated state of the thermal head and the platen roller, an art work material is arranged between both retaining frames, so that the screen is pinched between the thermal head and the platen roller. Then, the platen roller is driven and revolved so that platemaking is performed in a state that the thermal head is maintained at a fixed position and that the art work material is moved.

7 Claims, 4 Drawing Sheets

STENCIL SCREEN PLATEMAKING APPARATUS

BACKGROUND OF THE INVENTION

The present invention relates to a platemaking apparatus for a stencil screen used in screen printing and, in particular, to a stencil screen platemaking apparatus of a heat-sensitive platemaking method in which a thermal head contacts a screen with a heat-sensitive layer so that heating perforation is performed.

As a platemaking method for stencil screens, a photoengraving method has widely been used in which a positive film is placed on a silk screen provided with photosensitive emulsion thereon so that exposure and subsequent development are performed. Nevertheless, this method requires a large amount of effort and time. Thus, in recent years, a heat-sensitive platemaking method has been used in which heating perforation is performed by a thermal head.

In this heat-sensitive platemaking method, a screen fabricated by stacking a heat-sensitive layer composed of a polyester film having a thickness of 1 μm or the like onto fabric of silk mesh is stretched on a rectangular screen frame composed of aluminum alloy or the like. Then, a thermal head scans the surface so that heating perforation is performed on the heat-sensitive layer into a desired pattern. The heating perforation is performed through a controller that controls the heating of a resistor of the thermal head on the basis of input data of a platemaking pattern generated on a computer or loaded into the computer. This avoids a large amount of effort, and permits remarkably rapid platemaking. Further, this provides the advantage of easy correction, change, and the like of the platemaking pattern.

Nevertheless, the above-mentioned art work material for platemaking generates a step between the screen frame having a certain thickness and the thin screen. Thus, in a prior art stencil screen platemaking apparatus of a heat-sensitive platemaking method, an elastic plate or the like composed of rubber having a thickness corresponding to the step has been arranged as backing inside the screen frame, so that the thermal head has been moved by ensuring a pushing pressure against the heat-sensitive surface. Or alternatively, a platen roller has been arranged on the inner side of the screen, so that the platen roller and the thermal head pinch the screen and move in synchronization.

Nevertheless, in every prior art stencil screen platemaking apparatus of a heat-sensitive platemaking method, platemaking has been performed through scanning by the thermal head in a state that the screen-stretched screen frame is arranged horizontally in a housing. This places a limit on the size of the screen frame available for platemaking such that the screen frame should be accommodated within the housing. Thus, the necessary housing size has increased with the increasing screen frame size. This has caused an increase in the installation area, and hence reduced the space efficiency. Further, since the screen has been pulled by the movement of the thermal head in a pressing state relative to the fixed screen frame, expansion has easily been generated in the screen. This expansion has caused an error in the perforated platemaking pattern from the designed pattern, and hence caused the problem of degradation in the platemaking accuracy.

SUMMARY OF THE INVENTION

By considering the above-mentioned situation, an object of the invention is to provide a stencil screen platemaking apparatus of a heat-sensitive platemaking method, in which a wide range of screen frame sizes can be processed, while even a small apparatus can perform platemaking using a large screen-stretched screen frame, and while expansion in the screen in the platemaking is minimized so that high platemaking accuracy is achieved.

According to the invention, in a heat-sensitive platemaking method, a thermal head is maintained at a fixed position, while a screen of an art work material is pinched between the thermal head and a rotationally driving platen roller, so that platemaking is performed while the art work material is being moved. This completely avoids a restriction in the platemaking range along the movement direction, and permits the platemaking processing of a wide range of art work material size, covering from short to long platemaking sizes. Further, the available width of the screen frame can easily be enlarged by enlarging the passage space width on both sides of the screen frame in both retaining frames. Furthermore, the art work material can be set to move in a vertical direction. This reduces the apparatus installation area, and hence increases the space efficiency. Further, since the screen moves together with the screen frame, expansion in the screen in the platemaking is minimized so that high platemaking accuracy is achieved.

The other objects will become clear by the following description.

DETAILED DESCRIPTION OF PREFERRED EMBODIMENTS OF THE INVENTION

Figure 1B:
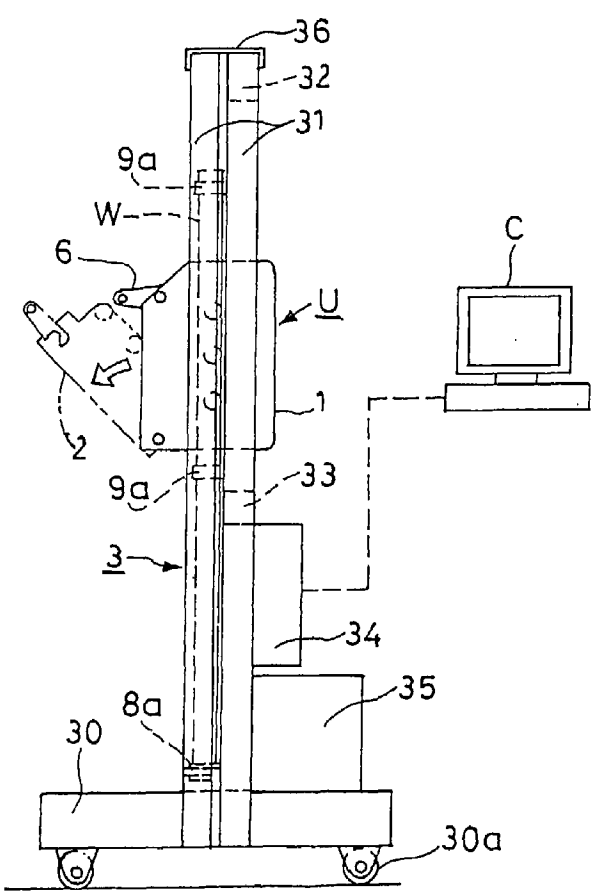
FIG. 1 shows a general view of a stencil screen platemaking apparatus according to an embodiment of the invention. Part (A) is a front view, while part (B) is a side view.
Figure 1A:
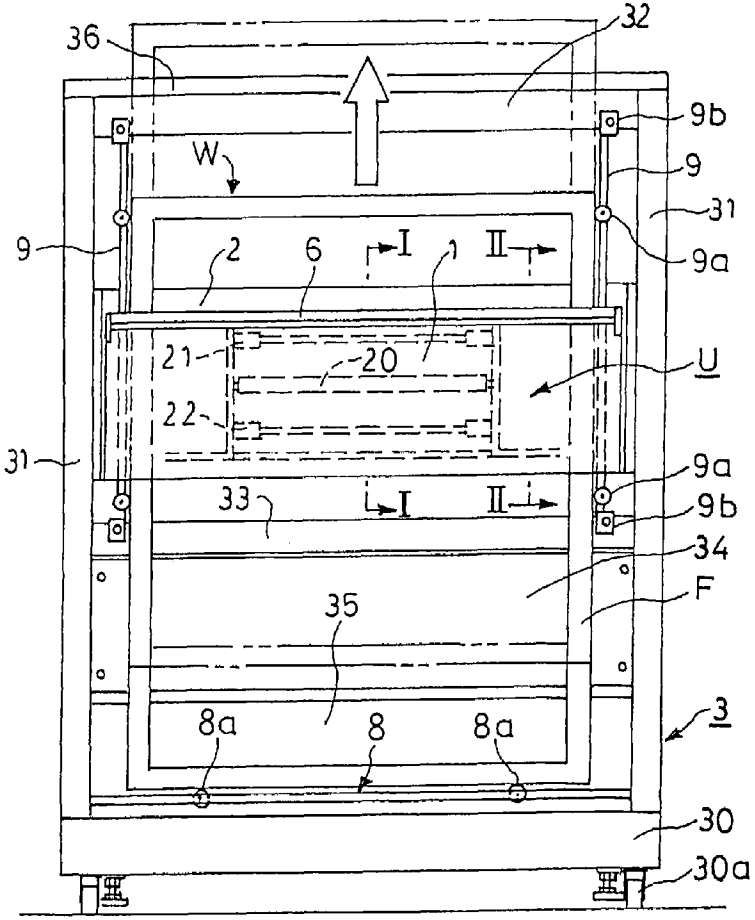
Figure 2:
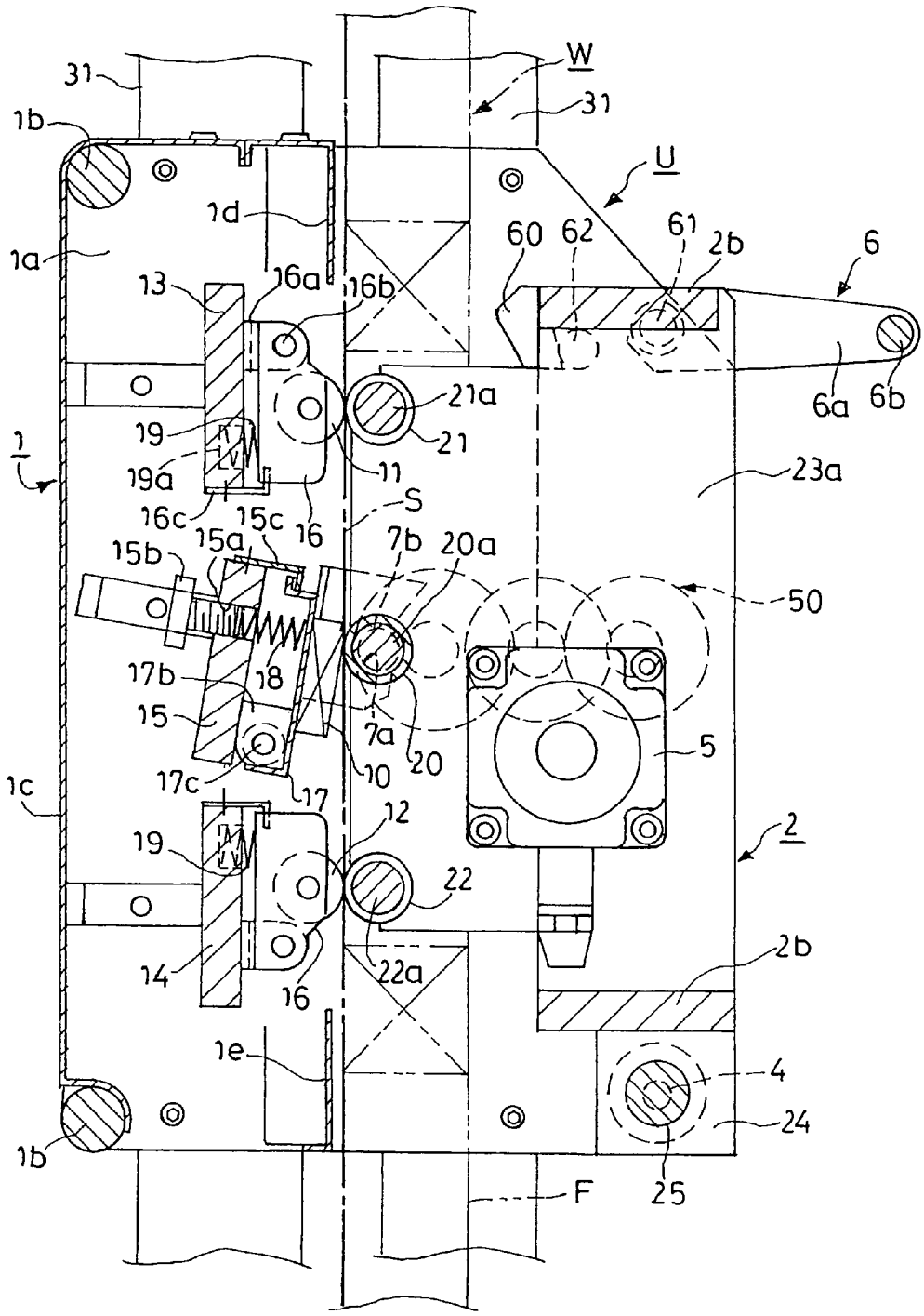
FIG. 2 is a sectional view of FIG. 1(A) taken along line I-I in the arrow direction, where a side guide is omitted.
Figure 3:
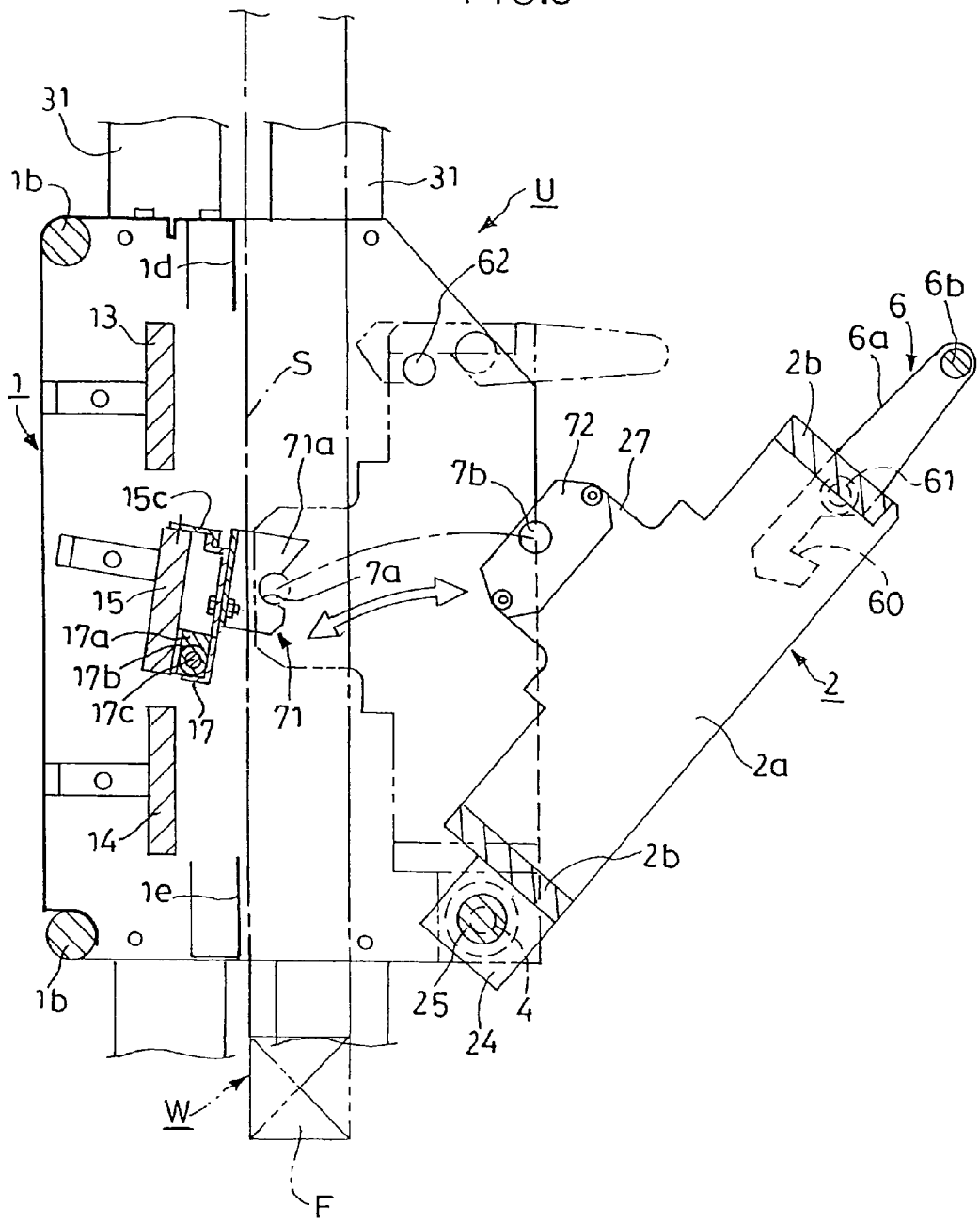
FIG. 3 is a sectional view of FIG. 1(A) taken along line II-II in the arrow direction, where a side guide is omitted and where a platen roller retaining frame is at an open position.
Figure 4:
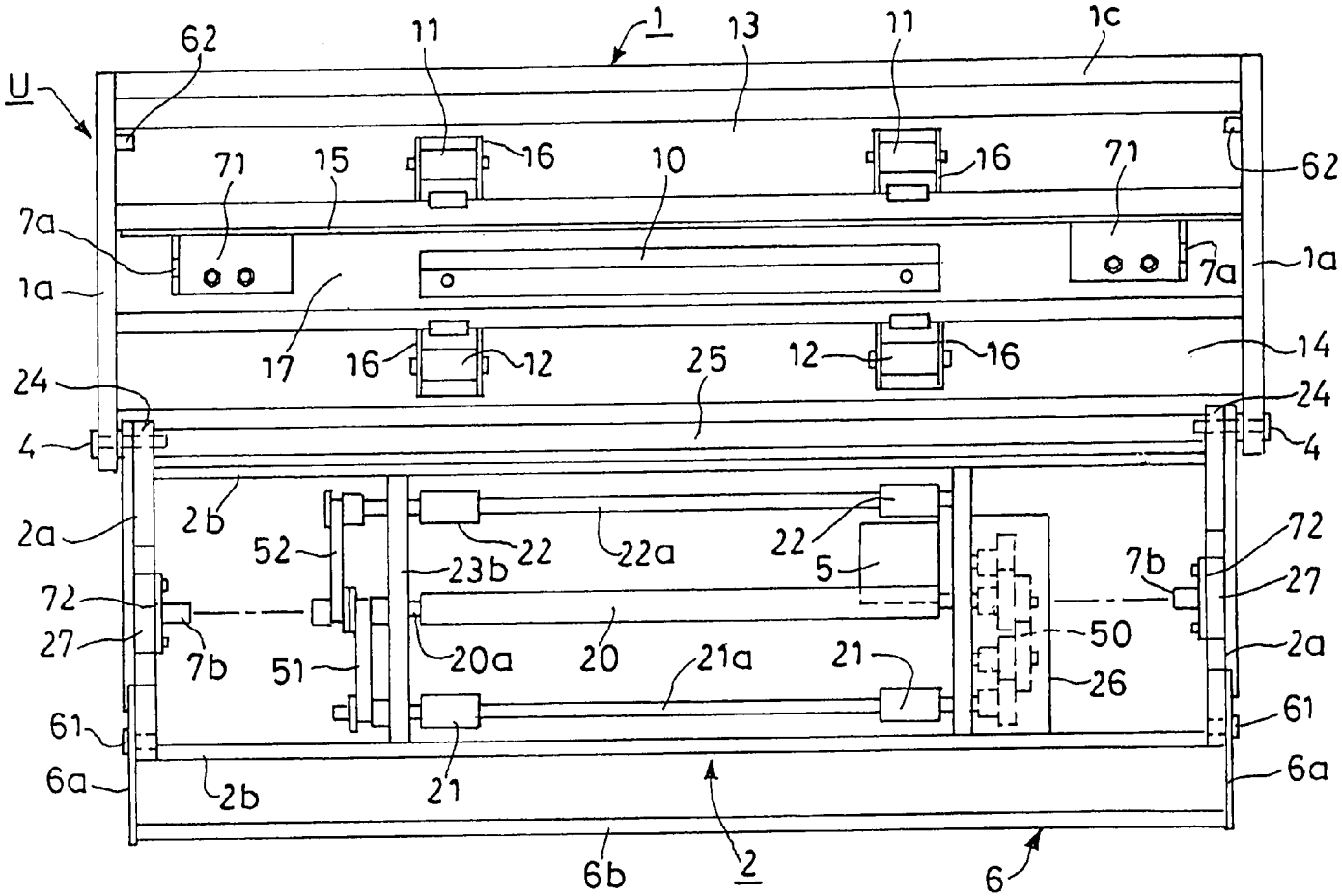
FIG. 4 is a plan view of a platemaking unit used in a platemaking apparatus, where a thermal head retaining frame and a platen roller retaining frame are expanded.

An embodiment of a stencil screen platemaking apparatus according to the invention is described below in detail with reference to the drawings. FIGS. 1(A) and 1(B) show a general view of a stencil screen platemaking apparatus. FIGS. 2-4 show a platemaking unit portion used in the platemaking apparatus.

As shown in FIGS. 1(A) and 1(B), in the stencil screen platemaking apparatus, two pairs of support columns 31 . . . are arranged closely to each other on the right and left sides in the middle of the frontward and rearward directions of a horizontal base 30 capable of moving by means of casters 30*a*. When the front face of FIG. 1(A) is defined as the front side, horizontal frames 32 and 33 are bridged in the upper and middle parts between the right and left support columns 31 on the rear side, while a platemaking unit U having a horizontally elongate housing is attached slightly above the middle horizontal frame 33. As a result, a vertical platemaking mount 3 is formed in which a vertically retained art work material W moves in a vertical direction and thereby passes through the platemaking unit U so that platemaking is performed. Numeral 34 indicates a sequence control box attached on the rear side slightly below the middle horizontal frame 33. Numeral 35 indicates a power supply box mounted on the rear side on the horizontal base 30. Numeral 36 indicates a top cover arranged over the entirety of the top ends of the four support columns 31. Here, although not shown, the top cover 36 is provided with a slit shaped opening for passing the art work material W in the vertical state.

As shown in FIGS. 2-4, the platemaking unit U comprises: a thermal head retaining frame 1 integrated by bridging shaft shaped bars 1*b* between the upper and lower rear corners of right and left side plates 1*a* having an approximately vertical rectangular shape having a diagonally-cut upper front corner; and a platen roller retaining frame 2 arranged on the front side between the right and left side plates 1*a* and pivotally fixed at the lower portion into the thermal head retaining frame 1.

In the thermal head retaining frame 1, upper and lower attaching frames 13 and 14 having a band plate shape and maintaining the front and rear principal surfaces vertically and a middle attaching frame 15 having a similar band plate shape and maintaining the front and rear principal surfaces slightly tilted to the front side are bridged at equal vertical intervals between the right and left side plates 1*a* slightly on the rear side. Then, idling rollers 11, 12 each having a horizontal axis are respectively attached via attachments 16 on both right and left sides of the front side of the upper and lower attaching frames 13 and 14. Further, on the front side of the middle attaching frame 15, a head supporting plate 17 having an approximately C-shaped vertical cross section and a length covering almost the overall length is attached with its concave side being oriented rearward. Further, in the middle of the entire surface of the head supporting plate 17, a thermal head 10 is fixed which has an approximate band plate shape and the heating of which is controlled by a controller in the sequence control box 34. Numeral 1*c* indicates a cover plate stretched over from the rear face to the upper face. Numerals 1*d* and 1*e* indicate guide plates stretched over the upper and lower parts in the middle position of the frontward and rearward directions.

Then, the head supporting plate 17 is pivotally supported by the attaching frame 15 at both right and left positions in a manner permitting tilt in the frontward and rearward directions, via a pivotal support pin 17*c* that penetrates a bearing member 17*a* (see FIG. 3) fixed to the lower rear face part and a bracket 17*b* fixed to the attaching frame 15. On the other hand, as shown in FIG. 2, in the attaching frame 15, a plurality of threaded holes 15*a* are drilled at equal intervals in the longitudinal direction within a length corresponding approximately to the rear face of the thermal head 10. Then, a spring pressure adjusting screw 15*b* is inserted into each threaded hole 15*a* from the rear side. Further, a coil spring 18 is inserted between the tip of each spring pressure adjusting screw 15*b* and the head supporting plate 17. Accordingly, the head supporting plate 17 is pressed and biased in the frontward tilt direction by these coil springs 18. However, its upper edge engages with a stopper plate 15*c* having an L-shaped vertical cross section and fixed to the upper edge of the attaching frame 15. This prevents frontward tilt exceeding the engagement position.

Further, as shown in FIG. 2, in the attachment 16 of each idling roller 11 or 12, one end (the upper end in the upper idling roller 11, and the lower end in the lower idling roller 12) is pivotally fixed via a pivotal support pin 16*b* to a bracket 16*a* fixed to the attaching frames 13 and 14. Further, in the other end, a biasing force in the frontward rotational direction is exerted by the coil spring 19 fitted in a retaining hole 19*a* provided in the front of the attaching frames 13 and 14. However, the engagement with a stopper plate 16*c* having an L-shaped vertical cross section and fixed to the attaching frames 13 and 14 prevents the frontward rotation exceeding the engagement position.

In the platen roller retaining frame 2, a rectangular frame is formed by right and left side plates 2*a* having an approximately vertical elongate band plate shape and having a middle part protruding rearward and by upper and lower band plates 2*b*. Then, wide roller supporting plates 23*a* and 23*b* protruding to the rear side more than these upper and lower band plates 2*b* are bridged between the upper and lower band plates 2*b* at two right and left positions on the inner sides of both side plates 2*a*. Further, a shaft shaped bar 25 is bridged between the downward extending sections 24 of both side plates 2*a*. Then, the platen roller retaining frame 2 is pivotally fixed to the thermal head retaining frame 1 by pivotal support pins 4 penetrating from the outer sides of the right and left side plates 1*a* of the thermal head retaining frame 1 through both downward extending sections 24 into both ends of the shaft shaped bar 25. Thus, the platen roller retaining frame 2 can transit between: a closed position where the platen roller retaining frame 2 is accommodated between the right and left side plates 1*a* of the thermal head retaining frame 1 and thereby constitute the housing; and an open position where the platen roller retaining frame 2 is inclined frontward at approximately 45 degrees via a tilting stopper not shown. Here, at the open position of the platen roller retaining frame 2, a gap allowing a thick screen frame F to pass through in the vertical direction is formed between both retaining frames 1 and 2 as shown in FIG. 3.

Between the right and left roller supporting plates 23*a* and 23*b* of the platen roller retaining frame 2, three shafts 20*a*, 21*a*, and 22*a* are arranged at a rear end side position in parallel to each other at equal vertical intervals with the shaft 20*a* being located in the middle. The middle shaft 20*a* constitutes a platen roller 20 provided with an elastic cover layer composed of rubber or the like extending approximately the overall distance between the roller supporting plates 23*a* and 23*b*. Further, as shown in FIG. 4, auxiliary feed rollers 21 and 22 provided with an elastic cover layer are arranged on both right and left sides of the upper and lower shafts 21*a* and 22*a*. Then, the dimensions are set up such that at the closed position of the platen roller retaining frame 2, the platen roller 20 should oppose and contact with the thermal head 10, while each upper auxiliary feed roller 21 should oppose and contact with each upper idling roller 11, and while each lower auxiliary feed roller 22 should oppose and contact with each lower idling roller 12.

Further, on the inner surface side of the right roller supporting plate 23*a*, a stepping motor 5 is attached that is driven and controlled by the controller in the sequence control box 34. Furthermore, on the outer surface side, a gearbox 26 is provided. Then, a linkage gear mechanism 50 arranged in the gearbox 26 transmits the rotational driving force of the stepping motor 5 to the shafts 20*a* and 21*a* of the platen roller 20 and the upper auxiliary feed roller 21. Further, on the outer surface side of the left roller supporting plate 23*b*, a timing belt 51 is wound around the shafts 20*a* and 21*a*, while another timing belt 52 is wound around the shafts 20*a* and 22*a*. Thus, when the stepping motor 5 is driven, the linkage gear mechanism 50 and the timing belts 51 and 52 allows the three shafts 20*a*-22*a* (that is, the platen roller 20 and the auxiliary feed rollers 21 and 22) to revolve in synchronization in the same direction.

Further, in the platen roller retaining frame 2, a lock lever 6 composed of a pair of right and left lock pieces 6*a* each having a hooking section 60 on one end side and of a handle bar 6*b* for linking the other ends to each other is pivotally fixed in the upper outside of a slightly front direction of the side plate 2*a* via a pivotal support pin 61 in a middle part of each lock piece 6*a*. On the other hand, on each of the inner surface sides of both right and left side plates 1*a* of the thermal head retaining frame 1, a lock pin 62 protrudes in an upper front part. Thus, as shown in FIG. 2, at the closed position of the platen roller retaining frame 2, the hooking section 60 of each lock piece 6*a* of the lock lever 6 in the horizontal position engages with each lock pin 62 so that the platen roller retaining frame 2 is locked at the closed position in an unopenable manner.

Then, as shown in FIGS. 3 and 4, an L-shaped positioning fitting 71 having a U-shaped notch 7*a* that opens frontward in a front protrusion piece 71*a* is fixed on both right and left sides of the head supporting plate 17 in the thermal head retaining frame 1. Further, a positioning plate 72 provided with a protruded centering pin 7*b* is fixed on each of the inner surface sides of both right and left side plates 2*a* in the platen roller retaining frame 2. Thus, at the closed position of the platen roller retaining frame 2, the centering pin 7*b* fits into the U-shaped notch 7*a*.

Here, each centering pin 7*b* is set up such as to be concentric with the rotational center axis of the platen roller 20 as shown in FIG. 4, and further such that in a state fitting into the U-shaped notch 7*a* of the positioning fittings 71, the platen roller 20 should oppose and contact with a heater line of the thermal head 10 as shown in FIG. 3. Further, the hole diameter of the bearing member 17*a* is set up slightly larger than the diameter of the pivotal support pin 17*c* for pivotally supporting the head supporting plate 17 in the attaching frame 15 at both right and left side positions. Thus, play corresponding to the amount of this diameter difference arises in the pivotal support position of the thermal head 10, that is, of the head supporting plate 17, relative to the attaching frame 15. Accordingly, even when expansion, contraction, bending, or the like is caused in the component member by a temperature change, a load, or the like, the fitting of the centering pin 7*b* into the U-shaped notch 7*a* always maintains the opposing and contacting position of the platen roller 20 and the thermal head 10 appropriately with high accuracy.

Here, as shown in FIG. 1(A), in a lower part between both side support columns 31 . . . of the vertical platemaking mount 3, a reference position setting plate 8 provided with receiving rollers 8*a* is attached in a manner permitting the adjustment of the vertical position. Further, between the upper and middle horizontal frames 32 and 33, a pair of right and left side guides 9 having a vertical rod shape and provided with guide rollers 9*a* are attached in a manner permitting the adjustment of the right and left position via fixation fittings 9*b* located between the upper and the lower sides, in a state passing through between the thermal head retaining frame 1 and the platen roller retaining frame 2 of the platemaking unit U.

When platemaking is performed in the stencil screen platemaking apparatus having the above-mentioned configuration, as shown in FIG. 1(B), data of a platemaking pattern generated on a computer C in advance or alternatively loaded into the computer C is inputted to the controller in the sequence control box 34 via a communications cable directly, or alternatively via a recording medium such as a CD. Then, the spacing between the right and left side guides 9 is first adjusted to the right and left width of the art work material W used as the platemaking target. Then, the platen roller retaining frame 2 of the platemaking unit U is set at the open position, so that the art work material W facing the screen S rearward is inserted from the top such as to pass through between the platen roller retaining frame 2 and the thermal head retaining frames 1. After that, the platen roller retaining frame 2 is returned to the closed position.

As a result, as shown in FIG. 1(A), the inserted art work material W is placed on the receiving rollers 8*a* of the reference position setting plate 8. Further, in a state that both right and left side parts of the screen frame F pass through the space between the side plate parts 1*a* of the thermal head retaining frame 1 and the roller supporting plates 23*a* and 23*b* of the platen roller retaining frame 2, the screen S with a heat-sensitive layer is pinched between the thermal head 10 and the platen roller 20. Furthermore, its upper and lower both sides are also pinched between the idling rollers 11 and 12 and the auxiliary feed rollers 21 and 22.

Then, in response to the operation of the stepping motor 5, the platen roller 20 and the auxiliary feed rollers 21 and 22 are driven and revolved in the upward feed direction. Then, heating perforation by the thermal head 10 is started at a predetermined time point, so that the art work material W moves upward at a constant speed while perforation of the desired pattern is achieved in the heat-sensitive layer of the screen S, so that platemaking is achieved into a stencil screen. In this case, the art work material W reaches an upward limit at a position where the lower part of the screen frame F contacts with the lower edge of the rear projecting part of the roller supporting plates 23*a* and 23*b* in the platen roller retaining frame 2. When the platemaking is completed in this way, the platen roller 20 and the auxiliary feed rollers 21 and 22 are driven and revolved in the downward feed direction by means of the counter rotation of the stepping motor 5, so that the art work material W having undergone the platemaking is lowered to the original position. Then, the platen roller retaining frame 2 of the platemaking unit U is set at the open position, so that the art work material W is extracted upward.

In this platemaking method, the thermal head 10 is maintained at a fixed position while the art work material W is moved, so that platemaking is performed. This completely avoids a restriction in the platemaking range along the movement direction, and hence permits the platemaking processing of a wide range of art work material W size, covering from short to long platemaking sizes. Further, the allowed width of the art work material W can easily be enlarged when the passage space width on both sides of the screen frame F is enlarged in both retaining frames 1 and 2. Furthermore, the screen S serving as the art work material W moves together with the screen frame F, while the art work material W is retained by pinching at three positions consisting of the upper, middle, and lower positions in cooperation with the platen roller 20 and the upper and lower pairs of the right and left auxiliary feed rollers 21 and 22, so that the feed is driven at these three pinching portions. Thus, expansion hardly arises in the screen S in the platemaking. Further, even with the above-mentioned upward movement, feeding is achieved smoothly, so that high platemaking accuracy is obtained.

Further, the fitting of the centering pin 7*b* into the U-shaped notch 7*a* always maintains the opposing and contacting position of the platen roller 20 and the thermal head 10 appropriately with high accuracy. Furthermore, the thermal head 10 is pressed and biased against the platen roller 20 at a plurality of positions in the longitudinal direction by the coil springs 18, while the spring pressure of each coil spring 18 can be adjusted so that the overall force can be adjusted. Thus, the contact pressure against the platen roller 20 can be set uniform along the overall length of the thermal head 10. This realizes remarkably high quality platemaking.

On the other hand, since this platemaking apparatus is of a vertical platemaking type in which the art work material W is moved in the vertical direction, only a small installation area is required as shown in FIGS. 1(A) and 1(B), so that high space efficiency is achieved. Further, the platemaking section including the feed mechanism for the art work material W constitutes a platemaking unit U in which the thermal head retaining frame 1 and the platen roller retaining frame 2 are pivotally fixed to each other. Thus, an appropriate installation mode and attaching mode can be selected in accordance with the surrounding condition of the platemaking part. That is, this apparatus is also applicable in a platemaking method in which the art work material W is fed downward or horizontally. Further, since the platemaking unit U can easily be conveyed, platemaking can be performed in any arbitrary site using this portable apparatus.

Here, in the platemaking unit U in the above-mentioned embodiment, the platen roller retaining frame 2 has been the movable side of the opening and closing. On the contrary, the thermal head retaining frame 1 may be the movable side of the opening and closing. Further, the pinching and feeding by the auxiliary feed rollers and the idling rollers may be performed solely on one of the upper and lower sides of the platen roller 20, in particular solely on the upper side, as in the above-mentioned embodiment. Further, in the thermal head retaining frame 1, the means for pressing the thermal head 10 against the platen roller 20 at a plurality of positions in the longitudinal direction may be composed of one of various spring materials other than the above-mentioned coil spring 18, or alternatively may be composed of an elastic material such as rubber. Furthermore, the pressing force adjustment means may employ various kinds of means other than the spring pressure adjusting screw 15*b* described above. Further, such pressing force adjusting means may also be applied to the idling rollers 11 and 12 and the auxiliary feed rollers 21 and 22.

Further, in the above-mentioned embodiment, as the means for maintaining the opposing and contacting position of the thermal head 10 and the platen roller 20 appropriately, play has been provided on the attaching section side of the thermal head 10, while the notch 7*a* on the thermal head 10 side is engaged with the centering pin 7*b* on the platen roller side. On the contrary, play may be provided on the attaching section side of the platen roller 20, while the above-mentioned notch 7*a* and centering pin 7*b* may be arranged on the opposite sides. Further, the notch 7*a* may have another positioning shape such as a V shape other than the U shape described above, while the attaching section to be provided with the above-mentioned play may employ various kinds of structures. Further, the torque transfer and synchronous rotation means between the shafts 20*a*-22*a* in the platen roller retaining frame 2 and between these shafts 20*a*-22*a* and the rotational driving shaft of the stepping motor 5 may employ a chain or a timing belt in place of the linkage gear mechanism 50, or alternatively may employ a gear or a chain in place of the timing belts 51 and 52.

In addition, in the stencil screen platemaking apparatus of the invention, detailed configuration can be designed in various manners in addition to the above-mentioned embodiment. These include: the locking mechanism between the thermal head retaining frame 1 and the platen roller retaining frame 2 in the platemaking unit U; the overall structure and the external appearance of both retaining frames 1 and 2; the structure of the reference position setting means for supporting the art work material W before the start of platemaking; the structure and the attachment method for the side guides 9; and the shape, the mutual linkage, and the attaching structure of other component members.

The movement of the art work material in the platemaking may be achieved in cooperation with the platen roller and the auxiliary feed rollers. This realizes smooth feed even in the case of a heavy screen frame, or alternatively even when a screen frame is moved upward. Further, since the screen is retained by pinching at a plurality of positions, expansion is even less likely to arise in the screen in the platemaking, so that much higher platemaking accuracy is achieved.

A platemaking unit may be formed in which the thermal head retaining frame and the platen roller retaining frame are pivotally fixed to each other. Thus, an appropriate installation mode and attaching mode can be selected in accordance with the surrounding condition of the platemaking part. Further, since the platemaking unit U can easily be conveyed, platemaking can be performed in any arbitrary site using this portable apparatus.

The attaching section of the thermal head and the attaching section of the platen roller may be positioned and engaged with each other with reference to one of these. This further improves the platemaking accuracy.

The thermal head may be pressed and biased at a plurality of positions in the longitudinal direction against the platen roller, while the pressing force of each part can be adjusted. Thus, the contact pressure between the thermal head and the platen roller can be set uniform along the overall length. This realizes much higher quality platemaking.

The platemaking may be performed by moving the art work material in the vertical direction. This reduces the apparatus installation area, and hence increases the space efficiency.

The invention claimed is:

1. A stencil screen platemaking apparatus in which a thermal head contacts with a screen with a heat-sensitive layer stretched on a screen frame of an art work material, while heating perforation is performed on the heat-sensitive layer of the screen into a desired pattern on the basis of input data from a controller, so that platemaking is performed, wherein a thermal head retaining frame to which the thermal head is attached and a platen roller retaining frame provided with a platen roller opposing the thermal head and with rotational driving means for the roller oppose and contact with each other in a manner permitting contact and separation between the thermal head and the platen roller, the platen roller retaining frame is provided with an auxiliary feed roller arranged in axi-parallel to and rotationally driving in synchronization with the platen roller, and wherein the thermal head retaining frame is provided with an idling roller that opposes and contacts with the auxiliary feed roller by pinching the screen with a heat-sensitive layer therebetween and thereby performs follower rotation, and the art work material is arranged between both retaining frames in a state that the thermal head and the platen roller are separated; the screen with a heat-sensitive layer is then pinched between the thermal head and the platen roller; and the platen roller and the auxiliary feed roller is then driven and revolved in a pinched state, so that platemaking is performed in a state that the thermal head is maintained at a fixed position and that the art work material is moved.

2. A stencil screen platemaking apparatus according to claim 1, wherein the thermal head retaining frame and the platen roller retaining frame are pivotally fixed in a manner permitting contact and separation between the thermal head and the platen roller, so that a platemaking unit is constructed.

3. A stencil screen platemaking apparatus according to claim 2, wherein one of a thermal head attaching section and a platen roller attaching section is provided with play, and wherein mutual engagement means is provided for positioning the one attaching section relative to the other attaching section.

4. A stencil screen platemaking apparatus according to claim 3, wherein pressing means for pressing the thermal head against the platen roller and pressing force adjusting means thereof are provided at a plurality of positions in a longitudinal direction of a thermal head support portion.

5. A stencil screen platemaking apparatus according to claim 4, wherein the thermal head retaining frame and the platen roller retaining frame are attached between support columns arranged in parallel to each other, while the art work material is moved in a vertical direction, so that platemaking is performed.

6. A stencil screen platemaking apparatus in which a thermal head contacts with a screen with a heat-sensitive layer stretched on a screen frame of an art work material, while heating perforation is performed on the heat-sensitive layer of the screen into a desired pattern on the basis of input data from a controller, so that platemaking is performed, wherein a thermal head retaining frame to which the thermal head is attached and a platen roller retaining frame provided with a platen roller opposing the thermal head and with rotational driving means for the roller oppose and contact with each other in a manner permitting contact and separation between the thermal head and the platen roller, the art work material is arranged between both retaining frames in a state that the thermal head and the platen roller are separated; the screen with a heat-sensitive layer is then pinched between the thermal head and the platen roller; and the platen roller is then driven and revolved in the pinched state, so that platemaking is performed in a state that the thermal head is maintained at a fixed position and that the art work material is moved, the thermal head retaining frame and the platen roller retaining frame are pivotally fixed in a manner permitting contact and separation between the thermal head and the platen roller, so that a platemaking unit is constructed, one of a thermal head attaching section and a platen roller attaching section is provided with play, and wherein mutual engagement means is provided for positioning the one attaching section relative to the other attaching section, and pressing means for pressing the thermal head against the platen roller and pressing force adjusting means thereof are provided at a plurality of positions in a longitudinal direction of a thermal head support portion.

7. A stencil screen platemaking apparatus according to claim 6, wherein the thermal head retaining frame and the platen roller retaining frame are attached between support columns arranged in parallel to each other, while the art work material is moved in a vertical direction, so that platemaking is performed.

* * * * *